United States Patent [19]

Song

[11] Patent Number: 4,759,722

[45] Date of Patent: Jul. 26, 1988

[54] PLUGS FOR COAXIAL CABLES

[76] Inventor: Jae C. Song, 295-9, Jangan 1-dong, dongdaemun-Ku, Seoul, Rep. of Korea

[21] Appl. No.: 76,076

[22] Filed: Jul. 21, 1987

[30] Foreign Application Priority Data

Oct. 11, 1986 [KR] Rep. of Korea ..... 15570/1986[U]

[51] Int. Cl.[4] ..... H01R 4/24

[52] U.S. Cl. ..... 439/394; 439/401; 439/410; 439/578

[58] Field of Search ..... 439/578–585, 439/607, 610, 609, 391, 394, 396, 399, 401, 409, 410, 731, 713, 696, 465, 466, 467, 675, 63, 701, 752

[56] References Cited

U.S. PATENT DOCUMENTS

| | | | |
|---|---|---|---|
| 3,977,752 | 8/1976 | Freitag | 439/394 |
| 4,129,352 | 12/1978 | Iizuka | 439/675 |
| 4,249,790 | 2/1981 | Ito et al. | 439/583 |
| 4,493,525 | 1/1985 | Hall et al. | 439/610 |
| 4,624,525 | 11/1986 | Ichimura et al. | 439/701 |
| 4,687,446 | 8/1987 | Birch et al. | 439/581 |

FOREIGN PATENT DOCUMENTS

| | | | |
|---|---|---|---|
| 1903398 | 9/1969 | Fed. Rep. of Germany | 439/583 |
| 695439 | 8/1953 | United Kingdom | 439/583 |

*Primary Examiner*—David Pirlot

*Attorney, Agent, or Firm*—Fleit, Jacobson, Cohn & Price

[57] ABSTRACT

A plug for coaxial cable of the type used for wire broadcasting transmission or multiplex communication system comprising a shielding cap. The shielding cap molded from a conducting material is connected to the cable without stripping the outer insulating material because several sharp-edged sector-shaped projections formed at the end of the shield cap penetrate into the outer insulation of the cable and their tips stick in the shielding net of the cable. A socket or other contact elements of other electrical circuits may or may not have a thread for engaging the assembled plug since the shielding cap itself is made of an elastic material which allows sliding fit instead of thread engagement.

2 Claims, 1 Drawing Sheet

FIG,1
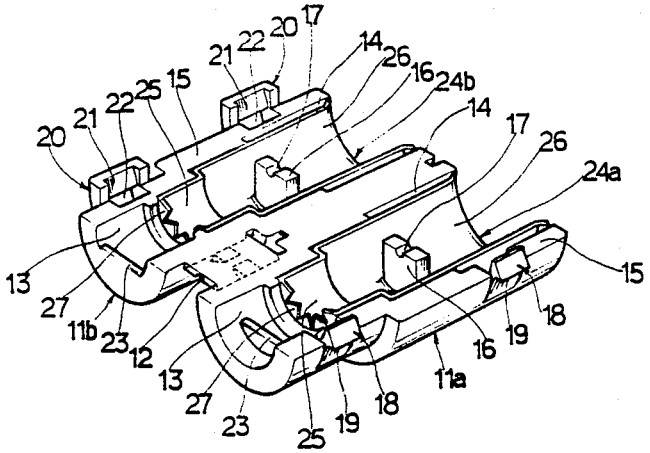
FIG,2
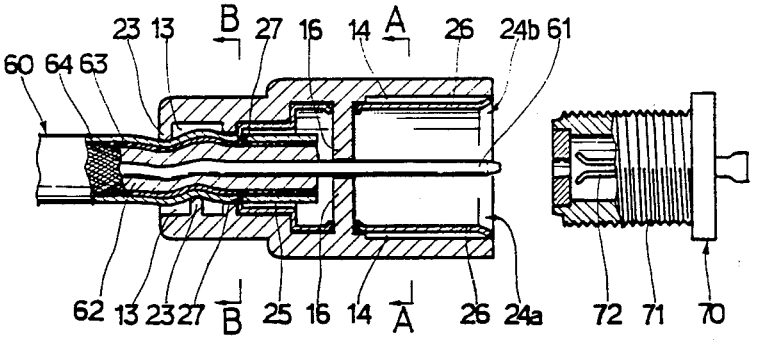
FIG,3
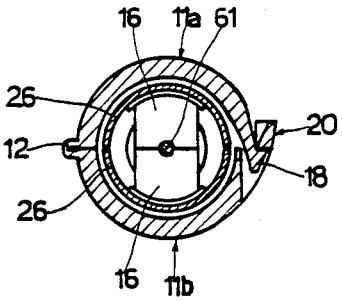
FIG,4
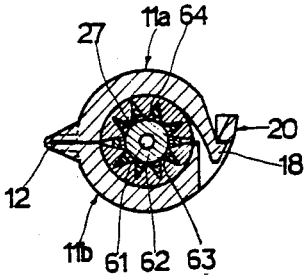

PLUGS FOR COAXIAL CABLES

FIELD OF THE INVENTION

The present invention relates to plugs and particularly concerns improvements in the design of the plugs for coaxial cables used for wire broadcasting transmission or multiplex communication system.

BACKGROUND OF THE INVENTION

The coaxial cable used in transmitting telegraph, telephone and television signals of high frequency generally consists of an insulated core wire encased by a shielding net with the whole assembly being covered with any suitable insulation.

It is conventional to provide a plug for connecting the coaxial cable of such construction to a socket which is utilized to connect devices to console units, or other contact elements of other electrical circuits. One type of plugs for such purpose is of complex construction due to a lot of components such as a connector member for the connection with the shielding net, some rings for fixing the connector member in place, a cap nut for being threaded into the socket thread, etc.

In assembling such plugs, the coaxial cable is provided by stripping the outer cover of the cable to expose a predetermined length of shielding net for the connection of shield cap thereto, thereafter the connector may be inserted between the shielding net and the insulator encasing core wire and then the cap nut connected with the connector member may be threaded into the socket for connecting the assembled plug with the socket or other contact emements of other electrical circuits.

This plug has numerous disadvantages among which are the following: its production cost is high due to a plurality of components thereof; it is cumbersome that the cap nut connected with the connector member is threaded into the socket; and the operation of such connection is not easily performed by anybody other than an expert.

SUMMARY OF THE INVENTION

An object of this invention is to overcome these known disadvantages of the prior art plug.

In particular, this invention provides a plug enabling contact with the shield net of the coaxial cable without stripping the outer cover thereof by providing a shield cap having means for coming into contact with the net.

In accordance with the present invention, there is provided an optionally locking and unlocking plug for a coaxial cable including an outer casing having two halves connected by a connector member therebetween, and a shield cap having two halves mounted within the corresponding halves of the outer casing respectively, radially formed sharp-edged sector-shaped projections formed at the one end of the shield cap.

BRIEF DESCRIPTION OF THE DRAWINGS

The above and other advantages of the invention will become more apparent in the following description and the accompanying drawing in which like numerals refer to like parts and in which:

FIG. 1 is a perspective view showing the inside of a plug constructed in accordance with the present invention;

FIG. 2 is a longitudinal view of a plug of the present invention, with a coaxial cable being positioned therein FIG. 3 is a cross sectional view taken along line A—A of FIG. 2; and FIG. 4 is a cross sectional view taken along line B—B of FIG. 2.

DETAILED DESCRIPTION OF THE INVENTION

Referring to the drawings, there is shown a plug 10 molded from plastic or the like including an outer casing 11 and a shield cap 24 mounted within and secured onto the casing 11.

The two halves a and b of the outer casing 11 are shown, one connected to the other by a connector member 12. Each half contains a smaller semi-cylindrical wall 13, a larger semi-cylindrical wall 14. Vertically projecting from about the middle part of the larger semi-cylindrical wall 14 is a core wire supporting projection 16 having a semi-circular open hole 17 for receiving the part of the round surface of a core wire 61 of the coaxial cable 60 when assembled (see FIG. 2). The top face of the core wire supporting projection 16 levels with the side flat end face 15 of the outer casing 11. Outwardly and displaced above the side flat end face 15 of the large semi-cylindrical wall 14 of the half 11*a* are two laterally spaced interlocking projections 18 which engage slidingly, at their bottoms 19, the bottoms of members 21 through holes 22 of the other interlocking members 20 formed beside the other half 11 B as clearly seen from FIG. 3. By this arrangement the plug is locked and unlocked easily.

Cable supporting members 23 are placed on the smaller cylindrical walls 13 of the outer casing 11 crisscross each other, with top surface being lower than the side flat end face 15 of the outer casing 11 as clearly shown in FIG. 1.

The two halves a and b of shielding cap 24 molded from a conducting material are shown, each half being mounted within each half of the outer casing 11 with the core support projection 16 being projected through larger wall 14 thereof. Each half of the shielding cap 24 extends from the back end to about the center part of the smaller semi-cylindrical wall 13 of the outer casing 11, and consists of a smaller semi-cylindrical wall 25 and a larger semi-cylindrical wall 26 the smaller semi-cylindrical wall 25 provides hole for receiving a suitable length of unstripped cable 60 and the larger one 26 provides hole for receiving a socket thread 71 of a socket 70 or other contact elements of other electrical circuits with a sliding fit instead of a thread engagement (see FIG. 2).

In assembling the preferred embodiment, cable 60 is prepared by stripping the outer insulation back to expose a predetermined length of core wire 61.

The exposed lengths of core wire 61 and some lengths of unstripped cable 60 are placed laterally within any half of the outer casing 11, with a portion of round surface of wire 61 being pressed into the semi-circular hole 17 and inner end of the unstripped cable being adjacent the core wire supporting member 16 as shown FIG. 2.

Thereafter, the outer casing 11 is folded along the center line of the connector member 12 and securely locked by the interlocking means 18, 20, and the cable is securely held in place by the cable support members 23. The pressure applied to the outer casing 11 when the plug 10 is locked causes each sector-shaped projection at the end of the shield caps 24 penetrates into the outer insulation 64 and the tip thereof directly contacts with the shielding net 63 of the cable.

The assembled plug 10 is connected to the socket 70 such as are used to connect devices to console units and the like by receiving the socket thread 71 with a terminal 72 into the hole provided by the larger semi-cylindrical walls 26 thereof, with a sliding fit instead of a thread engagement. And accordingly, a socket or the like coming into contact with elements without a thread may be used alternatively.

Obviously many modifications and variations of the present invention are possible in the light of the above teachings.

It is therefore to be understood that within the scope of the appended claims in the invention may be practiced otherwise than as specifically described.

What is claimed is:

1. A plug for connecting, a coaxial cable of the type having a core wire, an insulating material enclosing the core wire, a shielding net and an outer insulation, to a socket or other contact elements of other electrical circuits, which comprises:

an outer casing having two halves connected by a connector member therebetween, each half having a smaller and a larger semi-cylindrical wall and two interlocking means, said larger wall having a core wire supporting member vertically projected from about a middle part thereof;

a shielding cap having two halves smaller than said outer casing, each half of said shielding cap having a smaller and a larger semi-cylindrical wall, said smaller wall providing a hole for receiving some lengths of unstripped cable and said larger wall providing a hole for receiving a socket thread or the like with sliding fit and having said core wire supporting member being vertically projected therethrough when mounting within said outer casing; and several radially formed sector-shaped projections having sharp edges and being formed at the end of each smaller wall of said shielding cap.

2. A plug according to claim 1, wherein said core wire supporting member has a core wire receiving semi-circular hole formed on a top face thereof.

* * * * *